United States Patent [19]

Leight

[11] Patent Number: 4,750,669

[45] Date of Patent: Jun. 14, 1988

[54] CONTAINER WITH RESILIENT COVER

[76] Inventor: Howard S. Leight, 3945 Ridgemont Dr., Malibu, Calif. 90265

[21] Appl. No.: 70,357

[22] Filed: Jul. 7, 1987

[51] Int. Cl.[4] ..... B65D 5/64; B65D 25/22

[52] U.S. Cl. ..... 229/125.02; 229/125.19; 229/125.35; 206/461; 220/305

[58] Field of Search ..... 229/125.02, 125.05, 229/125.14, 125.19, 125.21, 125.23, 125.29, 125.33, 125.35, 125.37; 206/45.13, 45.14, 372, 380, 461, 484, 485, 486, 489, 490; 150/52 R; 220/305, 306; 383/68

[56] References Cited

U.S. PATENT DOCUMENTS

| | | | |
|---|---|---|---|
| 3,371,848 | 3/1968 | Ward et al. | 229/125.35 |
| 3,397,774 | 8/1968 | Tjaden | 206/45.34 |
| 3,765,595 | 10/1973 | Bernhardt | 229/125.35 |
| 3,819,043 | 6/1974 | Harrison | 206/449 |
| 3,946,871 | 3/1976 | Sturn | 229/123.1 |
| 3,997,677 | 12/1976 | Hirsch et al. | 229/125.35 |
| 4,397,391 | 8/1983 | Cornelissens et al. | 383/68 |
| 4,408,693 | 10/1983 | Brewaeys et al. | 206/461 |
| 4,474,016 | 10/1984 | Winchell | 229/125.35 |
| 4,589,568 | 5/1986 | Ito et al. | 229/125.35 |

FOREIGN PATENT DOCUMENTS

| | | | |
|---|---|---|---|
| 1397035 | 3/1965 | France | 229/125.33 |

*Primary Examiner*—Willis Little

*Attorney, Agent, or Firm*—Freilich, Hornbaker, Rosen & Fernandez

[57] ABSTRACT

A container is described, of a type which includes a resilient cover whose rearward portion is heat sealed to the flange of a container bottom or body and whose front can be bent up to gain access to the recess in the body. The cover is cut from a previously rolled sheet which is arched, and the convex side of the sheet faces upwardly so the front of the container cover tends to stay closed. The cover is heat sealed to opposite side flanges at locations lying forward of the rear of the recess by at least 25% of the length of the recess, to thereby more firmly keep the cover closed. The front of the cover and body are formed with aligned holes forward of the recess, so the container can be stored on a rod without the contents spilling out.

9 Claims, 2 Drawing Sheets

FIG. 1
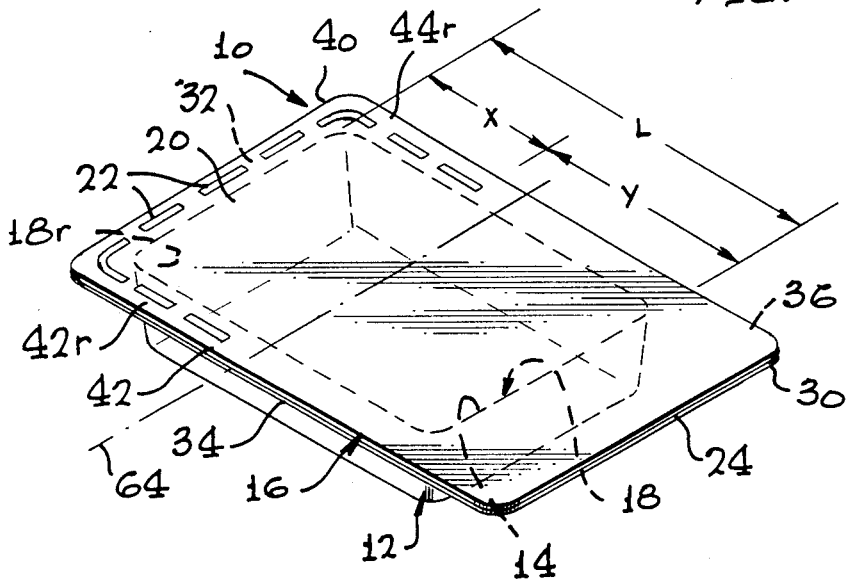
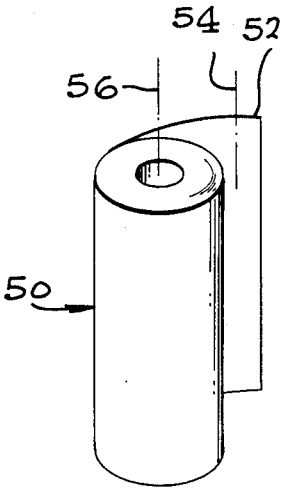
FIG. 3
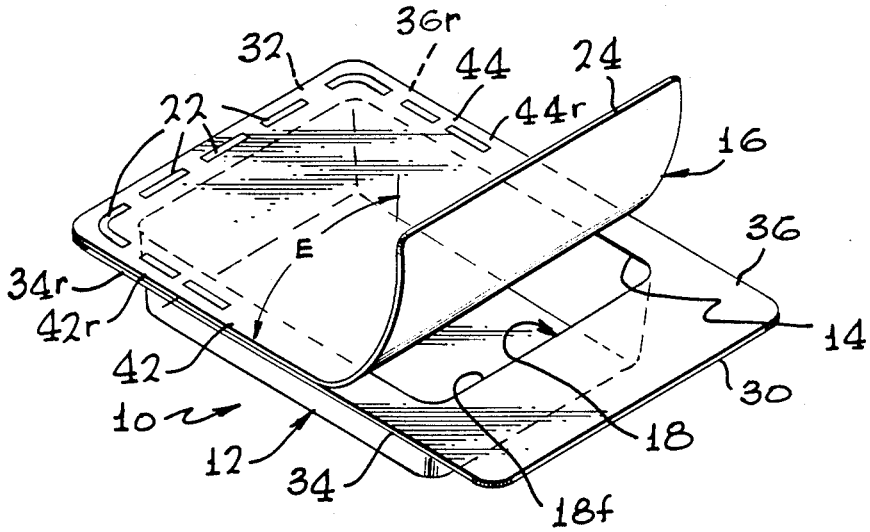
FIG. 2
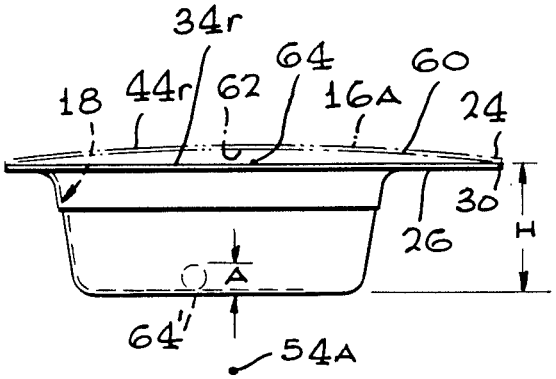
FIG. 4
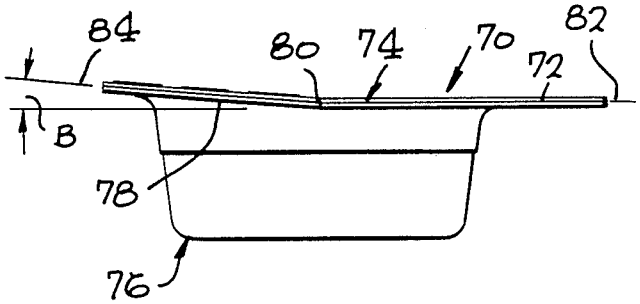
FIG. 5

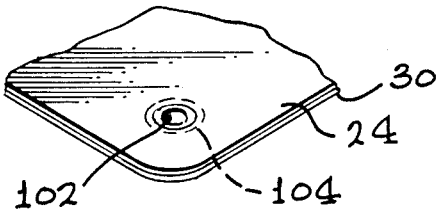
FIG. 6
FIG. 7
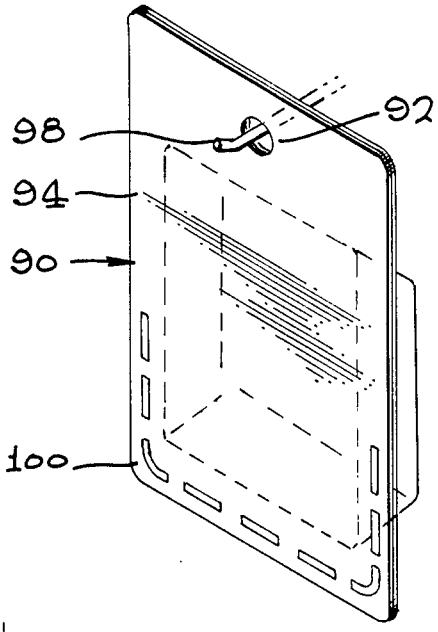
FIG. 8
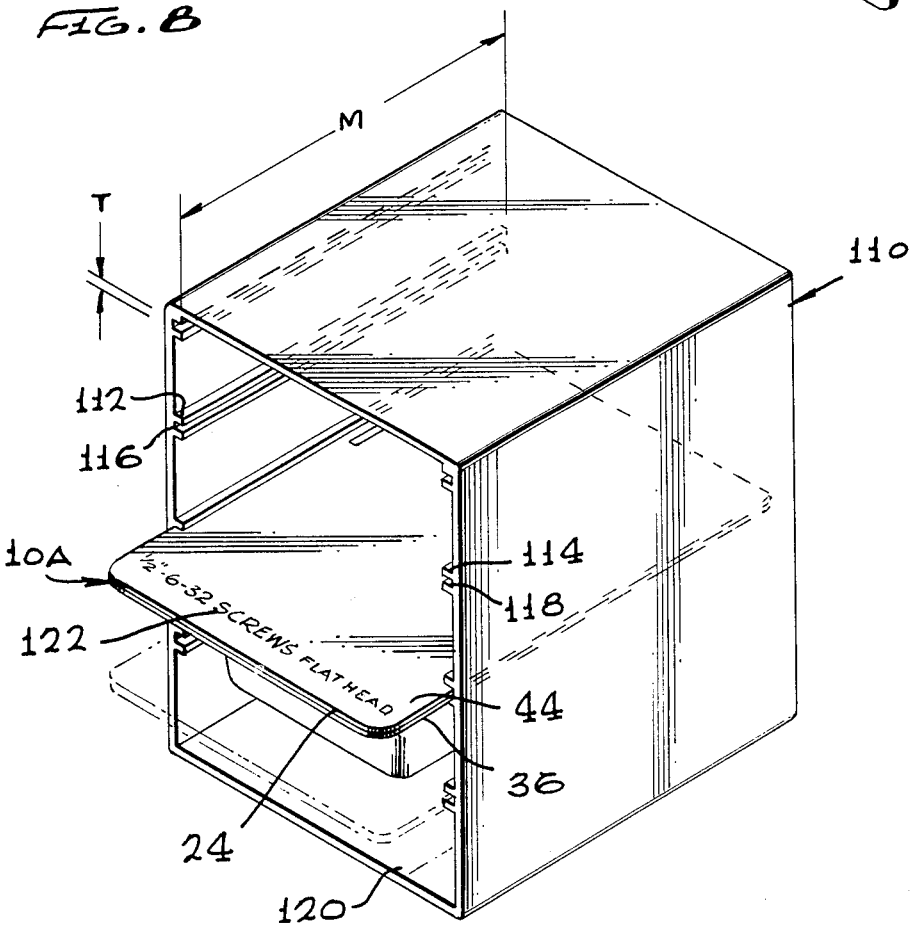

CONTAINER WITH RESILIENT COVER

BACKGROUND OF THE INVENTION

One type of package includes a recessed plastic body with a flanges around the top of the recess opening and a resilient cover whose rearward portion is heat sealed to the flanges. The front of the cover is bendable upward to gain access to the recess, and is intended to snap back flat against the front of the flanges when released. Articles can be placed in the recess and retrieved when the cover is bent up.

Applicant has constructed packages of this type with the cover sheets heat sealed to the rear flanges, and to opposite sides of the side flange at locations a small distance forward of the rear. The front cover portions of some of the containers tended to remain closed, while those of other containers tended to lie somewhat open, i.e., away from the front of the body flanges. For articles relatively large compared to the recess, slightly open covers did not present a substantial problem, although they detracted from a neat appearance. For the packaging of articles of relatively small size compared to the container, the slightly open cover can present a problem. A low-cost container of the type which includes a resilient sheet-like cover that snaps back after the front has been bent up, wherein the front tended to remain tightly closed, would be of considerable value.

SUMMARY OF THE INVENTION

In accordance with one embodiment of the present invention, a low-cost container of the type which has a resiliently bendable cover is provided, wherein the bendable portion of the cover tends to remain substantially completely closed. Where the cover is formed of a sheet which is arched, the cover is placed with its convex side uppermost, so that its concave side is adjacent the container bottom or body which is to be covered. With a rearward portion of the cover bonded to a rearward portion of the body, the front of the cover tends to press against the front of the body and remain closed. The front of the cover and the front of a flange on the body can be formed with a hole, so the containers can be stored on horizontal rods with minimal possibility of loss of the stored goods. The container body can be formed with flanges having opposite sides, and the cover can be heat sealed to the opposite sides at locations forward of one-quarter of the distance between the rear of the body recess and the front of the body recess. The body can have a downwardly-sloped upper rear portion, to further urge the cover closed.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a container constructed in accordance with one embodiment of the present invention.

FIG. 2 is a perspective view of the FIG. 1, but with the container open.

FIG. 3 is a perspective view of a roll of cover material.

FIG. 4 is a side elevation view of the container body, and also showing the cover in phantom lines, prior to bonding of the cover to the body.

FIG. 5 is a side elevation view of a container constructed in accordance with another embodiment of the invention.

FIG. 6 is a perspective view of a container constructed in accordance with another embodiment of the invention.

FIG. 7 is a perspective view of a container constructed in accordance with another embodiment of the invention, showing it stored on a rod.

FIG. 8 is a perspective view of a storage system which includes a storage housing and containers of a type similar to those of FIG. 1.

DESCRIPTION OF THE PREFERRED EMBODIMENT:

FIGS. 1 and 2 illustrate a container 10 which includes a body 12 with a recess 14 for holding articles, and a cover 16 which can be repeatedly closed and opened over an opening 18 formed at the top of the recess. Both the body 12 and cover 16 are formed from sheets of plastic material, with the body 12 being thermally formed to form the recess 14, and with the cover 16 being merely cut to shape. The cover has a rear portion 20 that is heat sealed to the body at bonding locations 22, and a front 24 that is not joined to the body and which is free to be lifted up. The cover 16 is resilient so it can be opened by bending up the front to the position shown in FIG. 2 to provide access to the recess 14. The cover is also stiff enough, so that when bending forces are removed, the cover snaps back to a closed position.

The body 12 includes flanges around the opening 18, including front and rear flanges 30, 32 and opposite side flanges 34, 36. The cover 16 has a periphery that substantially matches that of the flanges, the cover including a rear 40 and opposite sides 42, 44, in addition to its front 24. The cover 16 is joined to the body flanges 26 at the bonding locations 22 which lie at the rear 40 of the cover and at rearward portions **42*r*, 44*r*** of the opposite sides of the cover.

Although the containers 10 can be constructed at low cost and are useful for storage which requires repeated rapid opening and closing of the container, there can be a problem with the front 24 of the cover lying away from the front flange 30 of the body. This can result in a substantial gap through which small articles may fall out. It is possible to provide any of a variety of locking devices to hold the front of the cover down, but such locking devices increase the cost of manufacture and may increase the time and effort required to open the container which can defeat the advantage of this container of great ease in opening.

Applicant can bias the front of the cover down towards the front flange of the body, by proper orientation of a cover sheet which has a "natural" arch. FIG. 3 illustrates a roll 50 of a sheet 52 of clear polyvinyl plastic material out of which numerous container bodies and covers can be formed. Due to the rolling up of the sheet 52 at its time of manufacture, the sheet has a "natural" arch, in that when it is taken off the roll, it retains a curvature about axes such as 54 that are parallel to the axis 56 of the roll. When the sheet 52 is cut into covers, one of such covers may have a tendency towards an orientation shown at 16A in FIG. 4. The cover at 16A is laid on the flanges 26 of the container body 12, so that the convex surface 60 of the cover faces upwardly (when the container opening 18 faces upwardly) and with the concave surface 62 of the cover facing downwardly to lie facewise against the flanges 26 of the body. Also, the cover is oriented so one or more axes of curvature 54A of the cover extend parallel to an imaginary lateral line 64 that extends between the opposite flanges 34, 36 of the body. When the rearward portion **44*r* of the cover is bonded facewise to the rearward portions 34*r*, 36*r* of the body flanges, the front 24 of the cover tends to be pressed against the front flange 30 of the body. The pressure of the front of the cover against the front of the body can be sufficient to prevent the opening of a gap between them under the weight of small articles stored in the body even when the container is turned upside down so the cover 16** is lowermost.

The length X (FIG. 1) as measured from the rear **18*r* of the opening (at the level of the flanges) to the front 22*f* of the frontmost bonding locations is preferably at least one-quarter of the total length L of the opening as measured between its rear and front ends 18*r*, 18*f*, where the closing of the front of the cover is required, as to hold in small articles. Applicant earlier used a length X of only about 18% of the length L, for holding objects whose width, or smallest dimension, was at least one-half the height of the recess. However, with such a long free length Y of the cover over the recess, there waa danger that small articles would fall out of the container when it was held largely upside down or with the front pointing down, especially in those instances where the forward portion of the cover had a slightly upward bend. By providing a smaller free length Y when smaller articles are to be held, such as articles 64** of a smallest dimension A less than one-quarter the height H of the recess, there is more assurance that the articles will not fall out. Yet, the articles can be easily passed through smaller aperture created when the front of the cover is lifted.

FIG. 5 illustrates another container 70 designed to assure that the front 72 of the cover 74 will remain closed. The body 76 is formed so its upper flanges 78 do not all lie in the same plane. Instead, the rearward portion of the container, rearward of an imaginary lateral line 80, are tilted at an angle B of a plurality of degrees such as about 5°, from a plane 82 in which the forward portion of the flanges lie. That is, when the plane 82 of the forward flange portions is horizontal, the plane 84 of the rearward flange portions extend at a rearward-upward or forward-downward incline. This results in the cover 74 being bent near the location 80, which tends to keep the cover closed.

FIG. 7 illustrates another container 90 which is designed to enable the longer term storage of parts in the container, with ease of parts removal. The container has a pair of holes 92 in the front portion 94 of the cover in the front flange. This enables the container to be hung on a rod 98 that passes through the hole, so that sealed rearward portion 100 of the container is lowermost. This prevents parts from falling out of the container, even if there is a slight separation between the cover and container body. For removal of parts, a worker need merely remove the container from the rod and bend up the front of the cover to remove the parts. The forming of the holes can be accomplished at the same time as the periphery of the body and cover are punched out of a sheet, so that additional cost is very low.

When the containers are used to hold small articles placed there at a factory and with the containers handled several times during shipment and storage, the front of the container should be sealed to prevent accidental spillage and discourage unauthorized removal of articles. One simple sealing method, shown in FIG. 6, is to form heat seals such as 102 at either side of the front of the container, and to form perforations 104 in either the front flange of the body or the front of the cover. This technique, which is well-known, allows initial opening of the cover by pulling up the cover so as to tear the perforations. Of course, resilience of the cover is thereafter relied upon to keep it closed.

A container of the type shown in FIGS. 1 and 2 has been constructed for holding small objects, wherein both the body 12 and the cover 16 are constructed of clear polyvinyl sheet material of a thickness of 16 mil (one mil equals one-thousandth inch). The container has a width of about 3.3 inches, a height of about 1.1 inch, and a length of about 4.8 inches. The recess 14 has a width of about 2.5 inches, and a length L of about 3.3 inches near the opening of the recess. The length of heat sealing X forward of the rear of the recess is about 40% of the length of the recess.

FIG. 8 illustrates a storage housing 110 which can be used to store containers 10A such as the type shown in FIG. 1, in a manner that resists accidental spillage of small articles from the containers. The housing includes guides 112, 114 on either side of the housing that form groove-like guideways or grooves 116, 118.

The opposite edges 34, 36 and 42, 44 of the body and cover fit into the guideways. The thickness T of each guideway is only a small (less than 0.5 centimeters) amount, such as one millimeter more than the thickness of the body side flanges and cover sides, which prevents substantial opening of the cover while the container is in the housing. The length M of the guideways is more than one-half the length of container, to hold down the cover front. The front 24 of each cover projects from the front 120 of the storage housing, preferably by over one centimeter, to allow any container to be easily pulled out. A marking 122 on the front of the cover identifies the contents of the container, such as a particular one of may types of screws.

Thus, the invention provides a container of the type which includes a resilient cover with a rearward portion bonded to the flanges around the recess of a container body, and a front that can be bent up and rearward to gain access to the recess, which helps keep the front closed on the body when not intentionally bent up. The cover can be formed of a sheet with a natural arch, and the cover is attached with the convex face of the arch facing away from the container body, and the axes of curvature of the arch extending parallel to an imaginary line connecting opposite sides of the body. Where the contained articles have a smallest dimension less than one-quarter the height of the recess, the bonding of the rearward portion of the cover to the body flanges preferably extends forward of the rear of the recess by at least 25% of the length of the recess. With the front of the body flanges lying in a horizontal plane, the rearward portion of the body flanges can lie in a plane oriented at a rearward-upward incline of a plurality of degrees, so even an originally flat sheet will tend to remain closed. Storage of an article-filled container by the user is enhanced by forming a hole at the center of the front of the container, which enables the container to be hung from a rod, with the articles thereby prevented from falling out of the container even if the cover is slightly open. Container storage is also enhanced by providing a storage housing with narrow guideways that slideably receive the opposite sides of the container to resist container opening.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container comprising:

a body having walls forming a recess for holding articles, said walls forming an opening and flanges around said opening, said flanges including opposite side flanges;

a cover substantially in the form of a sheet and having a front, a rear, and opposite sides joined by an imaginary lateral line, said cover joined to said body flange at locations that lie at said opposite sides and closer to said rear than said front, said cover being resilient so it can bend when the front of the cover is lifted to provide access to the recess but being stiff enough to snap back when released;

said cover sheet having a tendency to arch substantially about an imaginary axis, and said cover sheet oriented so the face of the cover which is furthest from said body is convex and said axis extends substantially parallel to an imaginary lateral line connecting said opposite side flanges.

2. The container described in claim 1 wherein:

said body flanges include a forward flange, and said cover includes a front portion lying over said forward flange;

said forward flange and said cover front portion having aligned holes, whereby to enable hanging of said container on a rod with the front extending upwardly to avoid loss of contained articles.

3. A container comprising:

a body having walls forming a recess for holding articles and forming an opening, said body forming rear, front, and opposite side flanges around said opening, said side flanges having forward and rearward portions;

a cover substantially in the form of a sheet and having a front, a rear, and opposite sides, said cover opposite sides joined to said rearward portions of said opposite side flanges of said body, said cover being resilient so it can bend when the front of said cover is lifted and snap back when released;

said rearward portions of said body side flanges extending in a downward-forward direction at an angle of a plurality of degrees from the horizontal and lying above the level of said forward portions of said body side flanges, when said forward portions of said body side flanges extend horizontally.

4. A container comprising:

a body having walls forming a recess for holding articles, said walls forming an opening and flanges around said opening, said opening and flanges each having a rear, a front, and opposite sides;

a cover of resilient material substantially in the form of a sheet and lying over said opening and facewise over said flanges, said cover being heat sealed to said flanges at sealed locations on said rear flange and on said opposite side flanges;

said sealed locations including locations at said opposite side flanges which lie at least as far forward as an imaginary lateral line which extends between said opposite sides of said opening and which lies forward of said opening rear by at least 25% of the distance between the front and rear of said opening at the level of said flanges, said cover being free of heat sealing to said side flanges rearward of the front of said opening along a distance of at least 25% of said distance between the front and rear of said opening at the level of said flanges.

5. The container described in claim 4 wherein;

said cover has a front that lies over said body front, said cover and body form elements and the front of at least one of said elements has a hole, whereby to enable hanging of the container with its rear bottommost to avoid spillage of articles in the recess.

6. A method for forming a container, comprising:

forming a material into a container bottom which has a recess. an opening, and flanges around the opening including a rear, front, and opposite side flanges;

cutting a resilient sheet to form a cover which fits over said opening and placing said cover to lie substantially on said flanges, and welding locations on said sheet to said opposite side flanges wherein said locations lie closer to said rear flange than to said front flange;

said cover having an arching configuration, and said step of placing said sheet includes placing it with the axes of the arch parallel to an imaginary line extending between said opposite side flanges.

7. A storage system comprising:

a plurality of containers, each including a body having a recess with a top and flanges around the top of the recess including front, rear, and opposite side flanges, and a sheet-like resilient cover having opposite sides permanently bonded to the rearward portions of the said side flanges but free of permanent bonding to the forward portions of said side flanges, the front of said cover being bendable so it can be lifted to provide access to the recess but being stiff enough to straighten to reclose the recess when released, said opposite side flanges and opposite cover sides forming opposite sides of said container;

a storage housing having opposite sides and forming a plurality of pairs of guideways with one guideway of each pair at an opposite one of said housing sides, each guideway forming a groove;

each of said containers being storeable in said housing by sliding said opposite sides of said container along a pair of said grooves.

8. The system described in claim 7 wherein:

the thickness of each guideway is only slightly greater than the combined thickness of a side flange and cover side, and the length of each guideway is more than one-half the length of each container.

9. The system described in claim 7 wherein:

said housing has a front, and the front of said cover projects from said housing front and bears a marking identifying the articles in the container.

* * * * *